US010464125B1

(12) United States Patent
Kollock

(10) Patent No.: US 10,464,125 B1
(45) Date of Patent: Nov. 5, 2019

(54) METHODS, ASSEMBLIES, AND APPARATUSES FOR FORMING A WATER JACKET IN A CAST PART OF A MARINE ENGINE

(71) Applicant: Brunswick Corporation, Lake Forest, IL (US)

(72) Inventor: Mark A. Kollock, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 300 days.

(21) Appl. No.: 15/440,376

(22) Filed: Feb. 23, 2017

(51) Int. Cl.

| | |
|---|---|
| ***B22D 15/02*** | (2006.01) |
| ***B22D 25/02*** | (2006.01) |
| ***B22C 9/10*** | (2006.01) |
| ***B22C 9/22*** | (2006.01) |
| ***F01P 3/02*** | (2006.01) |
| ***F02F 1/36*** | (2006.01) |

(52) U.S. Cl.
CPC ..... *B22D 15/02* (2013.01); *B22C 9/10* (2013.01); *B22C 9/22* (2013.01); *B22D 25/02* (2013.01); *F01P 3/02* (2013.01); *F02F 1/36* (2013.01); *F01P 2003/024* (2013.01); *F01P 2050/02* (2013.01)

(58) Field of Classification Search
CPC .. B22C 9/10; B22C 9/22; B22D 15/02; B22D 25/02
USPC ..... 164/132, 137, 369
See application file for complete search history.

(56) References Cited

U.S. PATENT DOCUMENTS

| | | | | |
|---|---|---|---|---|
| 6,478,073 | B1 | 11/2002 | Grebe et al. | |
| 8,402,930 | B1 | 3/2013 | Taylor et al. | |
| 8,479,691 | B1 | 7/2013 | Taylor et al. | |
| 8,763,566 | B1 | 7/2014 | Taylor et al. | |
| 8,783,217 | B1 | 7/2014 | Taylor et al. | |
| 8,820,389 | B1 | 9/2014 | Degler | |
| 9,174,818 | B1 | 11/2015 | Langenfeld et al. | |
| 2017/0030249 | A1* | 2/2017 | Maki et al. ..... | F01P 3/02 |

* cited by examiner

*Primary Examiner* — Kevin P Kerns
(74) *Attorney, Agent, or Firm* — Andrus Intellectual Property Law, LLP

(57) ABSTRACT

Methods, assemblies and apparatuses are for forming a cooling jacket in a cast part of a marine engine, for example in a cylinder head for the marine engine. A cooling jacket core comprises a longitudinally elongated first portion that forms a first flow path for conveying cooling fluid through the cast part in a first direction and a longitudinally elongated second portion that forms an opposite, second flow path for conveying cooling fluid through the cast part in an opposite, second direction. At least one bridge integrally supports the first and second portions with respect to each other during casting. At least one plug is configured to fit in the cast part where the bridge was located so as to separate the first and second flow paths from each other while sealing the first and second flow paths from an opposite side of the cast part.

10 Claims, 8 Drawing Sheets

METHODS, ASSEMBLIES, AND APPARATUSES FOR FORMING A WATER JACKET IN A CAST PART OF A MARINE ENGINE

FIELD

The present disclosure relates to marine engines, and more particularly to cooling jacket cores for forming cooling jackets in cast parts of marine engines, and to methods and assemblies for forming cooling jackets in cast parts of marine engines.

BACKGROUND

The Background and Summary are provided to introduce a selection of concepts that are further described below in the Detailed Description. The Background and Summary are not intended to identify key or essential features of the claimed subject matter, nor are they intended to be used as an aid in limiting the scope of the claimed subject matter.

The following U.S. Patents are hereby incorporated herein by reference, in entirety:

U.S. Pat. No. 6,478,073 discloses a composite core structure used for metal casting in order to form cavities of preselected sizes and shapes within the casting. The composite core has an insoluble support member that can be metallic, and a soluble portion disposed around at least a part of the support member. When the composite core is used in a casting process, such as a die casting process, the soluble portion is dissolved after the casting process is complete, and the insoluble portion is then removed from the cavity that was formed through the use of the composite core.

U.S. Pat. No. 8,820,389 discloses a method for the high pressure die casting of an engine block assembly having at least one cast-in-place cylinder bore in the engine block and a closed head deck surface, and the resultant engine block. The closed deck high pressure die cast engine block assembly will preferably have at least two cast-in-place cylinder bores in the engine block formed by using a composite core of salt core material supported by at least one cylinder bore to be cast in place. The cylinder bores have a lower outer surface preferably defining at least one surface area that interfaces with the engine block during casting such that the at least one cylinder is cast in place in the engine block. An engine block cooling jacket—as defined by the salt core portion of the composite core—will preferably provide an open passage between each cylinder bore such that cooling fluid may flow around an entire outer circumference of the upper outer surface of the cylinder bores. This provides better and more uniform cylinder wall cooling, reducing thermal hot spotting and bore wall distortion.

U.S. Pat. No. 8,402,930 discloses a cooling system for a marine engine with various cooling channels and passages which allow the rates of flow of its internal streams of water to be preselected so that heat can be advantageously removed at varying rates for different portions of the engine. In addition, the direction of flow of cooling water through the various passages assists in the removal of heat from different portions of the engine at different rates so that overheating can be avoided in certain areas, such as the exhaust manifold and cylinder head, while overcooling is avoided in other areas, such as the engine block.

U.S. Pat. Nos. 8,479,691; 8,763,566; and 8,783,217 disclose a cooling system for a marine engine with various cooling channels which allow the advantageous removal of heat at different rates from different portions of the engine.

A split-flow of water is conducted through the cylinder head, in opposite directions, to individually cool the exhaust port and intake ports at different rates. This increases the velocity of coolant flow in the downward direction through the cylinder head to avoid the accumulation of air bubbles and the formation of air pockets that could otherwise cause hot spots within the cylinder head. A parallel coolant path is provided so that a certain quantity of water can bypass the engine block and avoid overcooling the cylinder walls.

U.S. Pat. No. 9,174,818 discloses a marine engine that includes a cylinder block having first and second banks of cylinders that are disposed along a longitudinal axis and extend transversely with respect to each other in a V-shape so as to define a valley there between. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

SUMMARY

Methods, assemblies and apparatuses are for forming a cooling jacket in a cast part of a marine engine. A cooling jacket core has a longitudinally elongated and monolithic body having an elongated first portion that forms a first flow path for conveying cooling fluid through the cast part in a first direction and an elongated second portion that forms an opposite, second flow path for conveying cooling fluid, such as water, through the cast part in an opposite, second direction. The first and second portions are laterally spaced apart from each other. The body further comprises at least one bridge that integrally supports the first and second portions with respect to each other during casting. At least one plug is configured to fit in the cast part where the at least one bridge was located so as to at least partially separate the first and second flow paths from each other, while sealing the first and second flow paths from an opposite side of the cast part.

BRIEF DESCRIPTION OF THE DRAWINGS

The drawings illustrate the best mode presently contemplated of practicing the concepts of the present disclosure. The same numbers are used throughout the drawings to reference like features and like components. In the drawings.

DETAILED DESCRIPTION OF THE DRAWINGS

During research and experimentation, the present inventor has endeavored to invent improved assemblies, apparatuses and methods for forming cooling jackets in cast parts of marine engines. More particularly, the present inventor has identified certain problems associated with current assemblies, apparatuses and methods for forming cooling jackets in cast parts of marine engines. Even more particularly, as described in the above-incorporated U.S. Pat. Nos. 8,479,691; 8,763,566; and 8,783,217; known cast parts in outboard marine engines have cooling jackets (e.g. passageways or channels for conveying water or any other cooling fluid) that promote removal of heat at different rates from different portions of the engine. As explained in the above-incorporated patents, it is known to produce a split-flow of cooling fluid through a cast part of the engine, for example a cylinder head, in opposite directions, to individually cool the exhaust ports and intake ports at different rates. This has been found to advantageously limit accumulation of air bubbles and formation of air pockets which could otherwise cause hot spots within the cylinder head. Various other functional advantages also result from such an arrangement.

Figure 1:
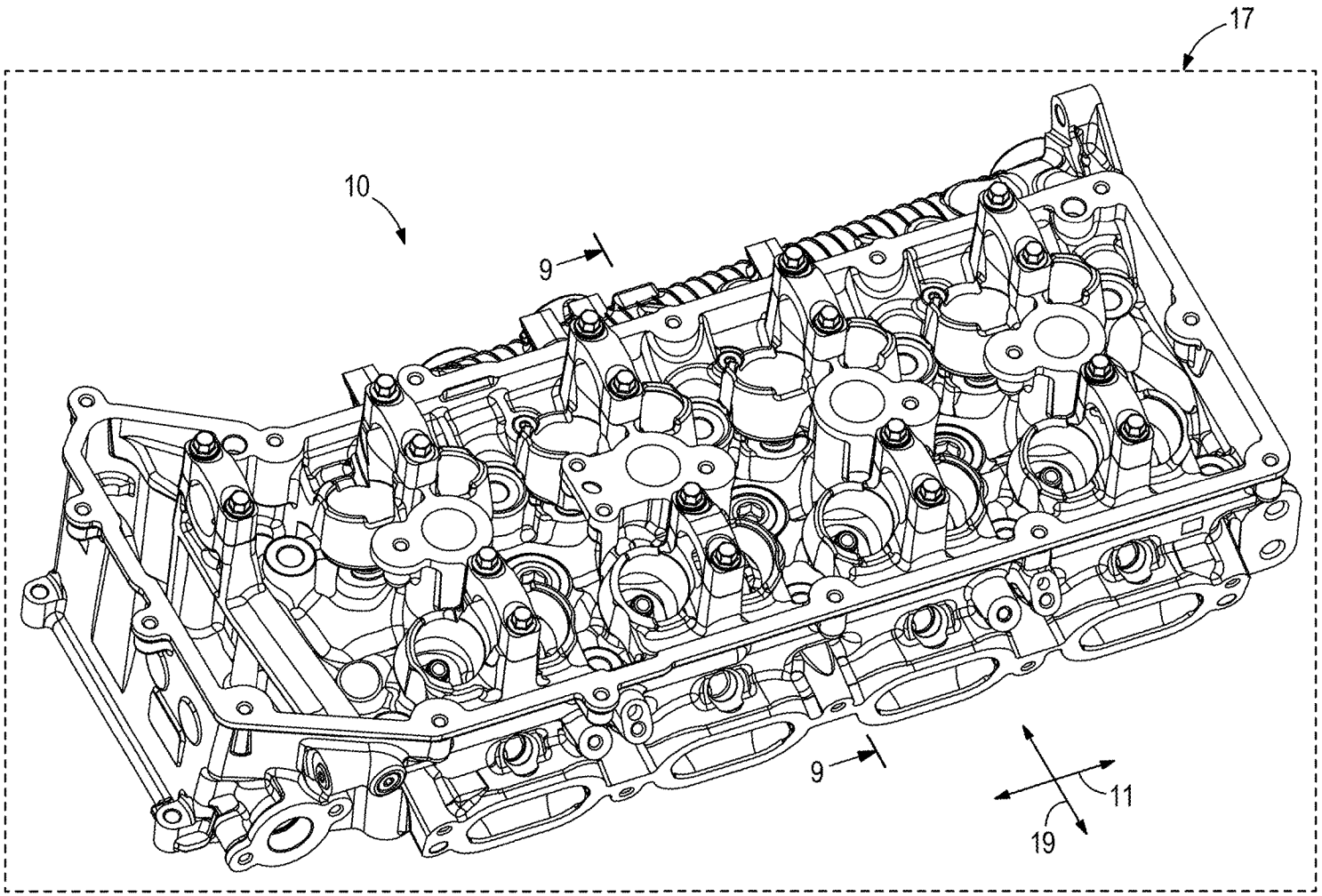
FIG. 1 is a perspective view of a cast part of a marine engine, in this example a cylinder head for a marine engine.

FIG. 1 depicts an exemplary cylinder head 10 for an internal combustion engine 17, which is made of metal and is formed by a casting process. Similar to the cylinder heads 10 shown and described in the above-incorporated U.S. Patents, the cylinder head 10 has a pair of cooling channels that split the flow of cooling fluid through the cylinder head 10 in opposite directions. The cylinder head 10 is a cast part that extends from top to bottom along a longitudinal axis 11 and from side to opposite side along a lateral axis 19 that is perpendicular to the longitudinal axis 11.

Figure 2:
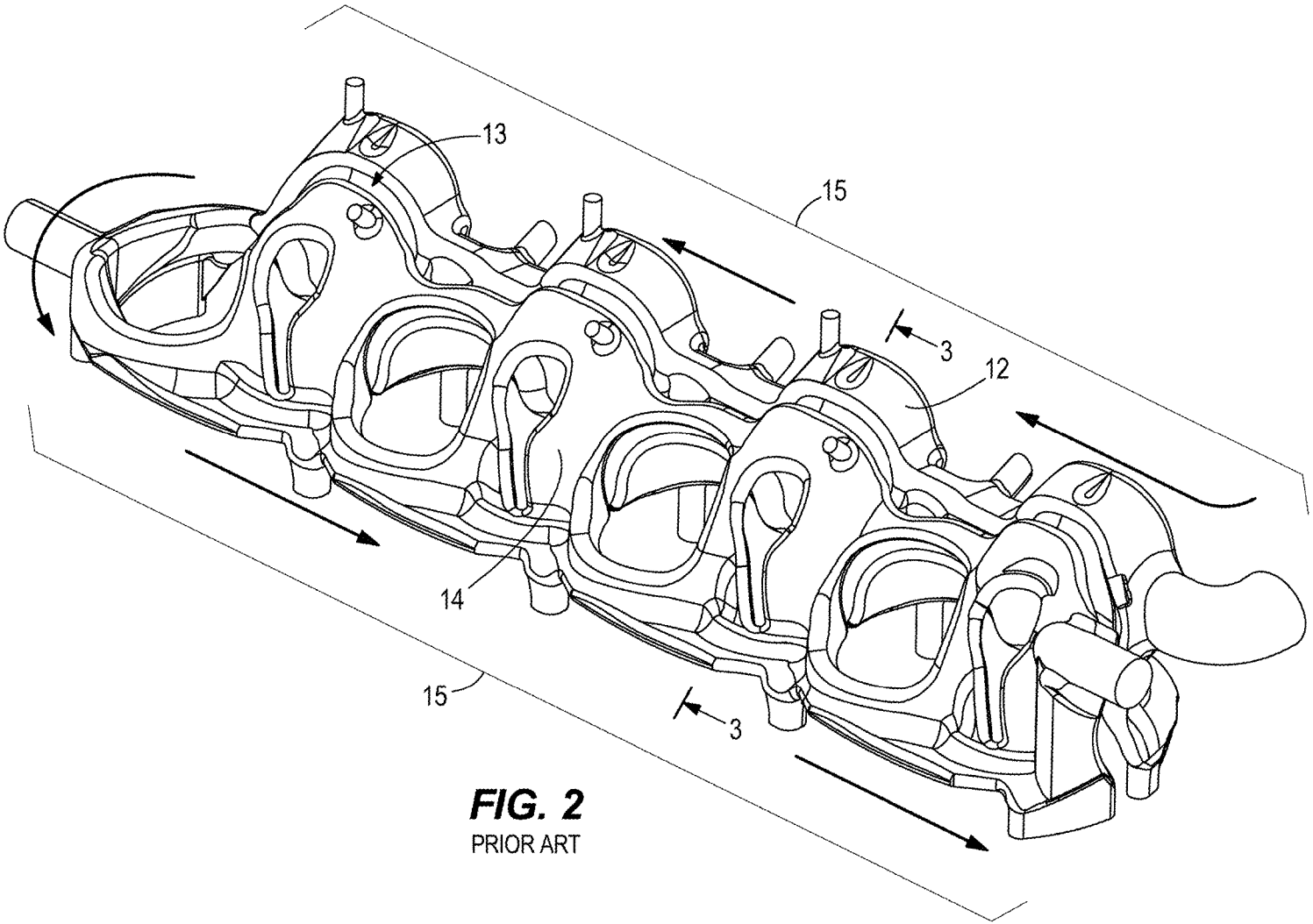
FIG. 2 PRIOR ART
FIG. 2 is a perspective view of a prior art two-part cooling jacket core for forming a cooling jacket in a similar but slightly different cylinder head than the cylinder head shown in FIG. 1.
Figure 3:
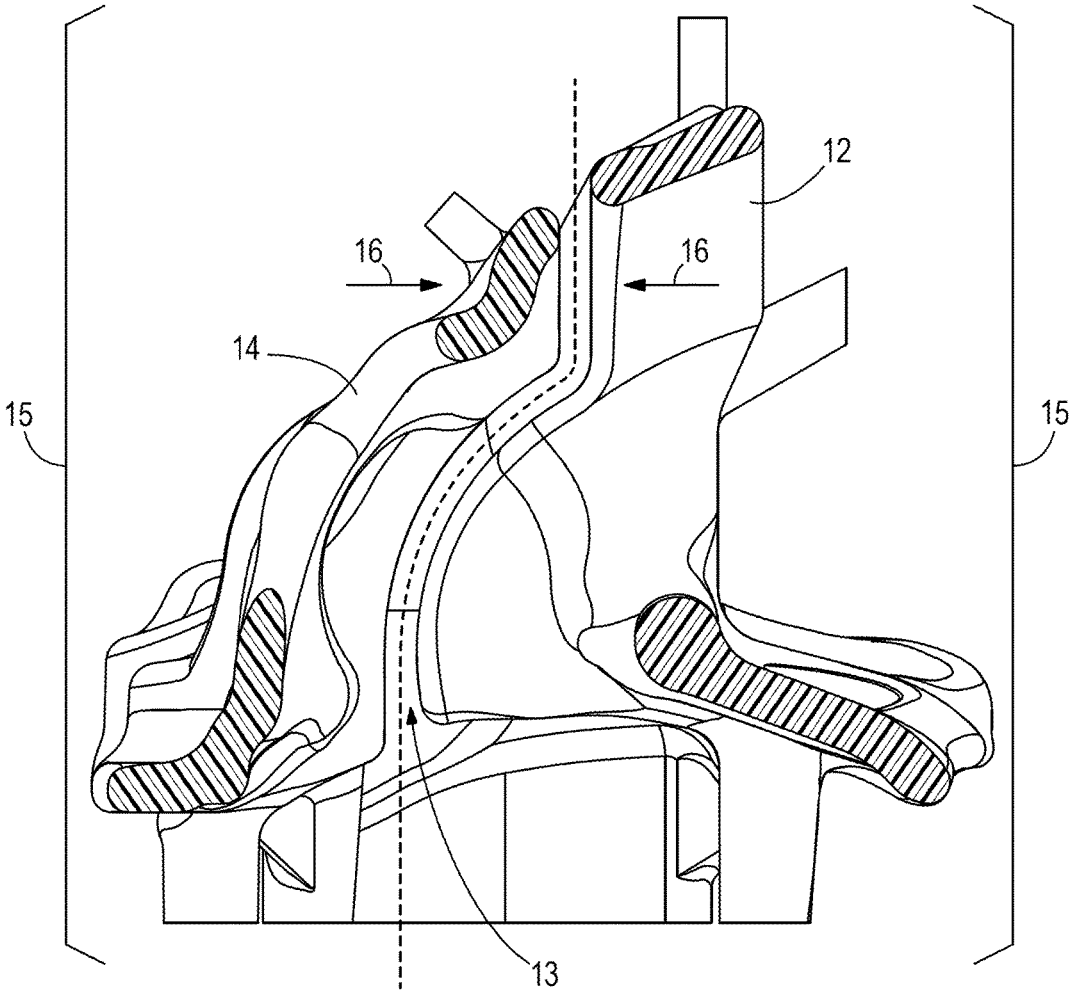
FIG. 3 PRIOR ART
FIG. 3 is a view of section 3-3 taken in FIG. 2, showing an undesirable movement (e.g., tipping) that occurs during use of the prior art cooling jacket core in the casting process.

FIGS. 2 and 3 depict conventional cooling jacket cores 12, 14, which are used during the casting process to form the above-described cooling channels in a cylinder head similar to the cylinder head 10 shown in FIG. 1 (referred to herein below with the same reference number: 10). The cooling jacket cores 12, 14 are separate from each other (see arrow 13) so that as the metal is cast, the cooling jacket cores 12, 14 form two separate cooling channels. According to prior art methods, prior to casting the metal, each cooling jacket core 12, 14 is placed into a mold (shown schematically at 15) for the cylinder head 10 and is supported with respect to the mold by, for example, supporting printouts and/or other conventional supporting mechanisms. Then, liquid metal is cast into the mold 15 and caused flow around the various contours of the cooling jacket cores 12, 14. The liquid metal is allowed to cool until it solidifies around the cooling jacket cores 12, 14 and forms the cast part. Thereafter, the cooling jacket cores 12, 14 are broken down and removed by conventional methods, leaving behind the noted two separate longitudinally extending cooling channels in the cylinder head 10. As explained in the above-incorporated patents, the cooling channels are advantageously configured to carry the noted split-flows of cooling fluid in opposite directions through the cast part.

Referring to FIG. 3, the present inventor has identified problems with conventional methods of casting. Specifically, the present inventor has found that because the cooling jacket cores 12, 14 are not connected to each other (see arrow 13), they are difficult to properly support in the mold 15. Therefore the two cooling jacket cores 12, 14 are prone to move (e.g. tip, translate and/or break) during the casting process, particularly with respect to mold 15, and even more particularly with respect to each other (e.g., see arrows 16). Such tipping, translating, and/or breaking of the cooling jacket cores 12, 14 during the casting process can cause the final cast part to be defective, and/or result in inefficiencies of manufacture, and/or result in an undesirably high amount of scrap (waste). Through research and experimentation, the present inventor has identified this problem and has endeavored to provide improved assemblies, apparatuses and methods for forming a split-flow cooling jacket in a cast part of a marine engine that do not suffer from the drawbacks of the prior art.

Figure 4:
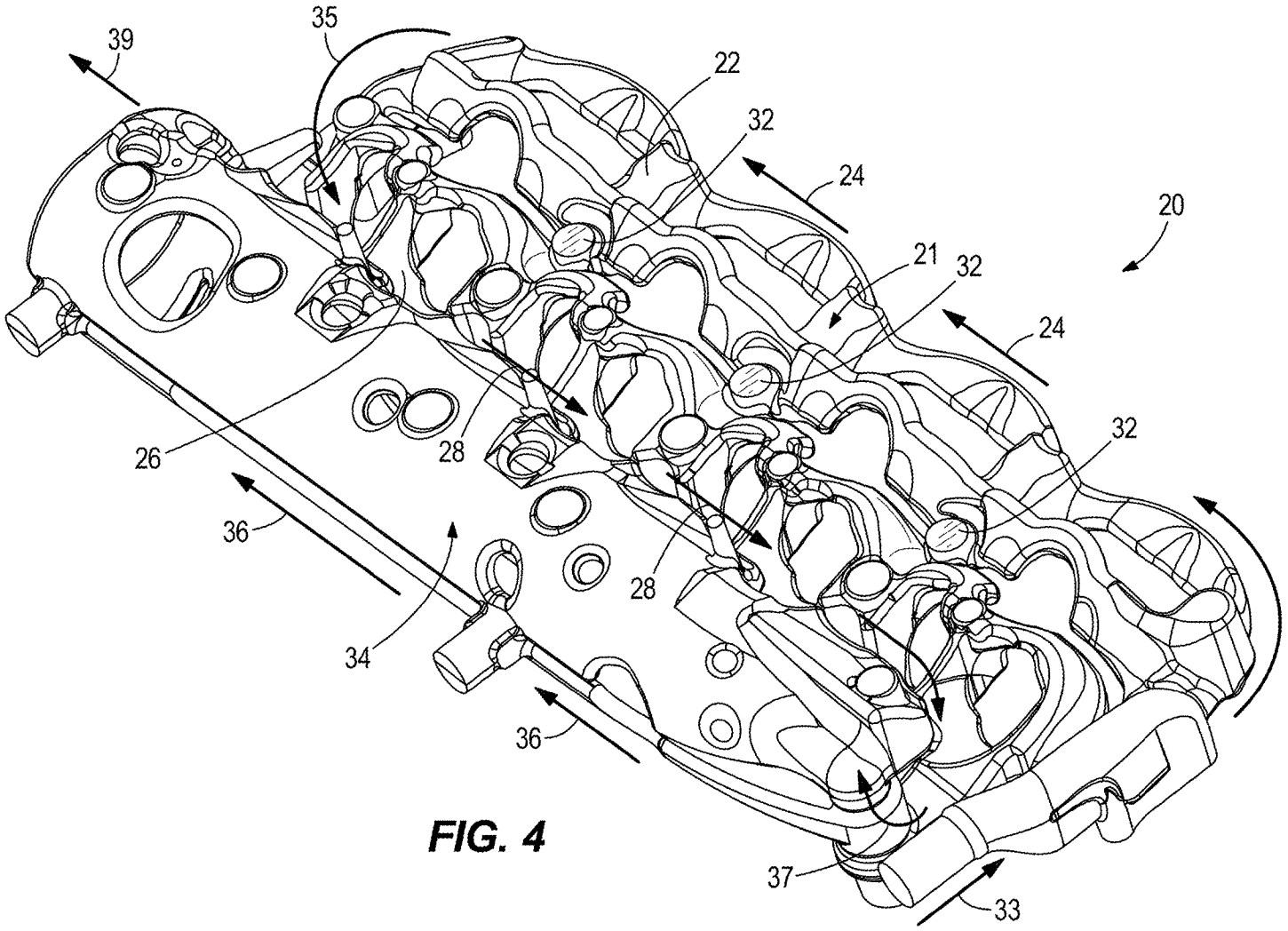
FIG. 4 is a perspective of an improved elongated monolithic cooling jacket core for forming a cooling jacket in a cylinder head, such as shown in FIG. 1.
Figure 5:
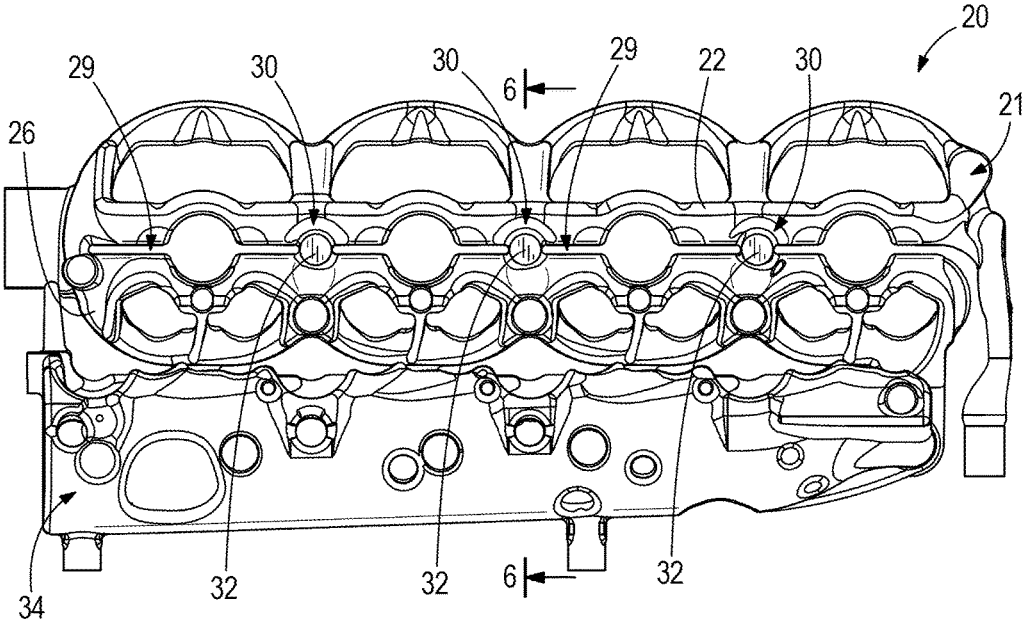
FIG. 5 is a top view of the cooling jacket core shown in FIG. 4.
Figure 6:
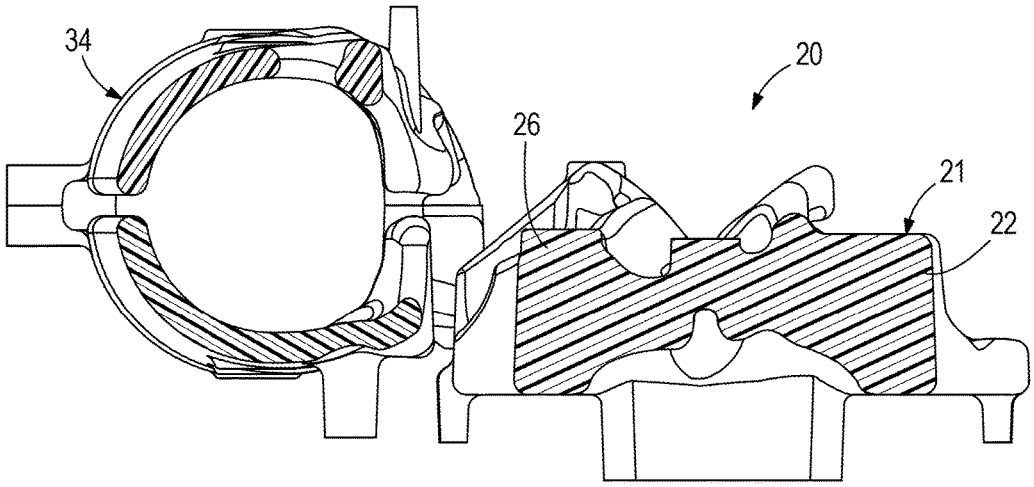
FIG. 6 is a view of section 6-6, taken in FIG. 5.

Referring now to FIGS. 4-6, the present inventor has invented an improved cooling jacket core 20 and improved assemblies and methods for forming a split-flow cooling jacket in a cast part of a marine engine, for example in the above-described cylinder head 10 of an internal combustion engine 17. The cooling jacket core 20 includes a longitudinally elongated and monolithic (i.e., one-piece) body 21 that has a longitudinally elongated first portion 22 that forms a first flow path for conveying cooling fluid through the cylinder head 10 in a first longitudinal direction (see arrows 24), and a longitudinally elongated second portion 26 that forms an opposite, second flow path for conveying cooling fluid through the cylinder head 10 in an opposite, second longitudinal direction (see arrows 28). The first and second portions 22, 26 are laterally spaced apart from each other (e.g., see the space at arrow 29 in FIG. 5) and yet are firmly connected together by a plurality of laterally extending bridges 30, each of which integrally supports the first and second portions 22, 26 with respect to each other prior to and during the above-described casting process.

Optionally, the cooling jacket core 20 further includes a plurality of supporting printouts 32, which in the illustrated example are located adjacent to (e.g. formed with or fixed to) the respective bridges 30 and are configured to support the cooling jacket core 20 with respect to the mold 15 prior to and during the casting process. The location and configuration of the bridges 30 and printouts 32 can vary from what is shown in the drawings. Optionally, the bridges 30 and printouts 32 are co-located and are longitudinally spaced apart along the cooling jacket core 20. Optionally, the bridges 30 and printouts 32 are interdigitated amongst the locations of cylinders on the internal combustion engine 17. Additional bridges 30 and/or printouts 32 can be included. Effectively, the bridges 30 act as "tie bars" so that the monolithic cooling jacket core 20 is strong enough to be handled and placed in the mold 15 without breaking and the printouts 32 act as supporting members for the monolithic cooling jacket core 20 once it is placed into the mold 15.

The illustrated cooling jacket core 20 also includes an elongated third portion 34, which forms a third flow path (see e.g., arrows 36) for cooling fluid to flow alongside an exhaust conduit that is integrally cast with the cylinder head 10 and configured to convey exhaust gas from the internal combustion engine 17. This type of integrally-formed exhaust conduit and cylinder head 10 is disclosed in the above-incorporated U.S. Pat. No. 9,174,818.

Thus, as shown by the arrows in FIG. 4, the cooling jacket core 20 forms a series of flow paths for cooling fluid (i.e., cooling jacket passages) through the cylinder head 10, including the along the noted first and second oppositely oriented longitudinal flow paths 24, 28, as well as along the third longitudinal flow path 36. The cooling jacket core 20 can also be configured to form one or more connecting inlets (see e.g. arrow 33) for cooling fluid to enter the first flow path 24, one or more reversing conduits (see e.g. arrow 35) for connecting the first and second flow paths 24, 28, one or more reversing conduits (see e.g. arrow 37) for connecting the second and third flow paths 28, 36, and one or more outlet passages (see arrow 39) for discharging cooling fluid from the cast part. Additional connections for entry, and/or conveyance, and/or exit of cooling fluid from the above-described cooling circuit can be included, for example inflow of cooling fluid from an engine block (not shown) associated with the internal combustion engine 17, as described in the above-incorporated patents. The respective conduits can be formed by the cooling jacket core 20 during the casting process and/or formed by subsequent machining and/or other processes.

Referring to FIGS. 4-6, the cooling jacket core 20 includes various contours that are specially configured to form a cooling jacket that conveys the cooling fluid in close proximity and alongside of various structures of the cylinder head 10, including for example intake and exhaust valve structures, bearings, etc., as described in the above-incorporated U.S. Patents. However it should be understood that the type of cast part (here, the cylinder head) and the exact configuration of the cast part (e.g. the size, shape and configuration of contours) can vary from that which is shown. The concepts of the present disclosure are not limited for use with a cylinder head, and can be used to form any other type of cast part having cooling jackets.

Figure 7:
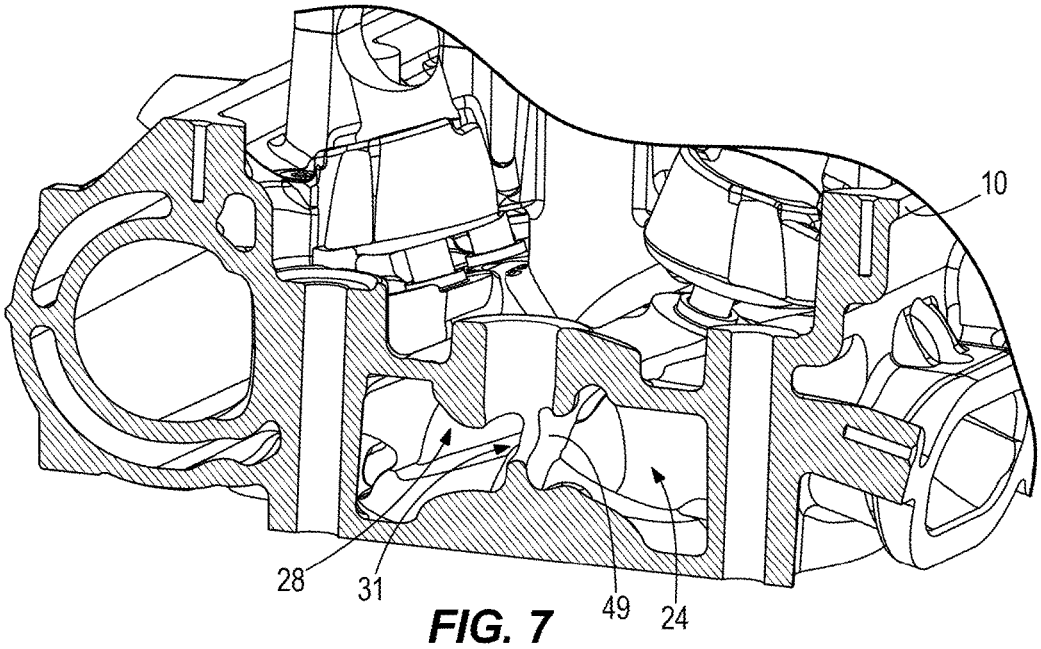
FIGS. 7-9 are views of section 9-9, taken in FIG. 1, showing the cylinder head at various stages during the casting, machining and assembly processes.

FIG. 7 is a lateral cross-section of the cylinder head 10 after it has been formed by casting using the improved cooling jacket core 20. Once the cast part cools and the cooling jacket core 20 is broken down and removed by conventional methods, the respective first and second flow paths 24, 28 remain. The first and second flow paths 24, 28 are laterally separated from each other by metal (cast) portions of the cylinder head 10 (e.g., see dividing wall 49) except for passageways where the bridges 30 were once located (e.g., see arrow 31).

To fully isolate the first and second flow paths 24, 28 from the opposite side of the cast part (here the lubricated side of the cylinder head), to further isolate the first and second flow paths 24, 28 from each other, and to allow for the above-described split-flows (with or without controlled short circuiting), a plug 40 (e.g., see FIGS. 10, 12, 13) is inserted into and configured to seal with the passageway 31. As further described herein below, the type and configuration of the plug 40 can vary and can be selected based upon desired performance characteristics.

Figure 13:
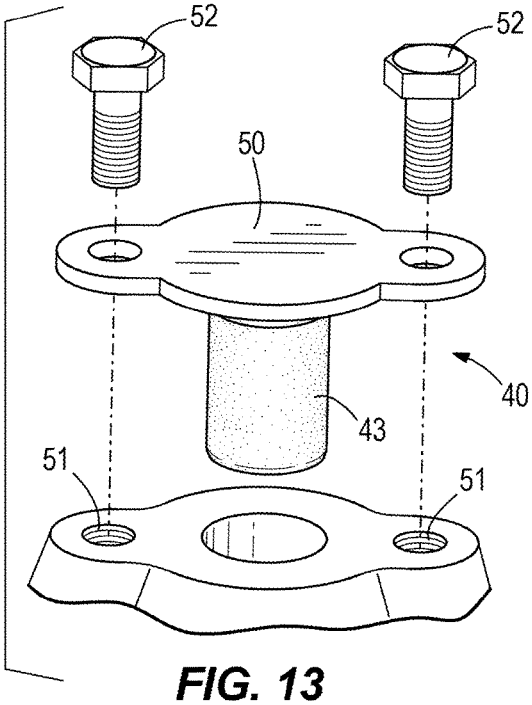
FIG. 13 shows another example of a plug for isolating the cooling fluid in the first and second flow paths from the opposite side of the cast part.

FIG. 13 depicts one example of the plug 40, which is inserted into the passageway 31 after the cast part is cooled and after the core is broken down. The plug 40 is advantageously configured to seal with the passageway 31 without requiring additional machining of the passageway 31, which as described herein below is an optional step. The plug 40 has a top bracket 50 that is affixed to the opposite side (here, the oil deck) of the cast part by fasteners 52, which extend through the top bracket 50 and into threaded passageways 51. The plug 40 has a body 43 which can be made of metal and/or rubber. The body 43 is sized small enough to fit in the passageway 31, but large enough to seal with the passageway 31 when the top bracket 50 is affixed to the opposite side of the cast part, and thus prevent flow of cooling fluid from the first and second flow paths 24, 28 to the opposite side of the cast part, here the oil deck of the cylinder head 10.

Figure 8:
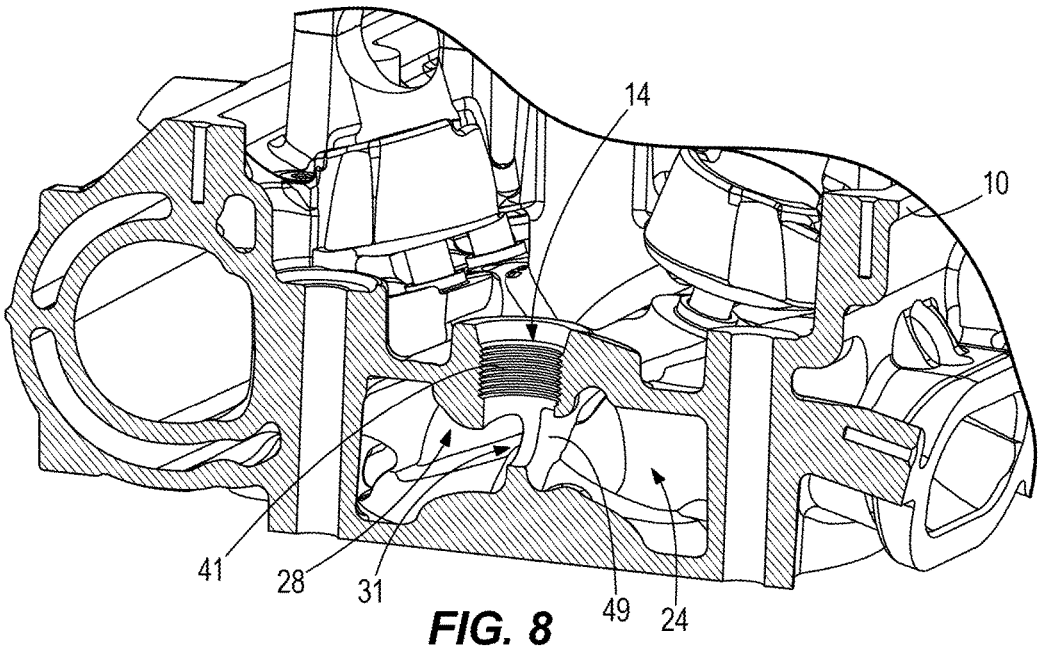

Optionally, the location wherein the bridges 30 were once located can be machined (e.g. drilled or milled, etc.) to form a larger and/or more precise passageway 31 (see FIG. 8) having a selected diameter or shape that better corresponds to the width or shape of a plug 40. FIG. 8 is a view like FIG. 7, showing the passageway 31 after it has been machined. In this example, threads 41 have been machined into the passageway 31 for engaging with the one of the plugs 40 shown in FIGS. 10 and/or 12.

Figure 9:
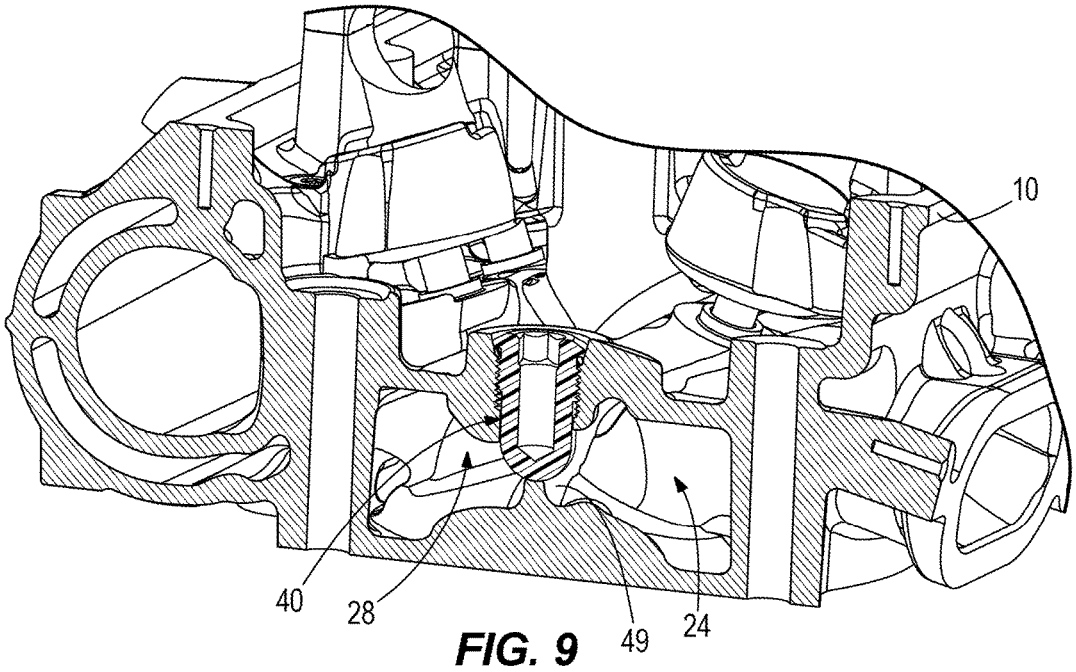
Figure 10:
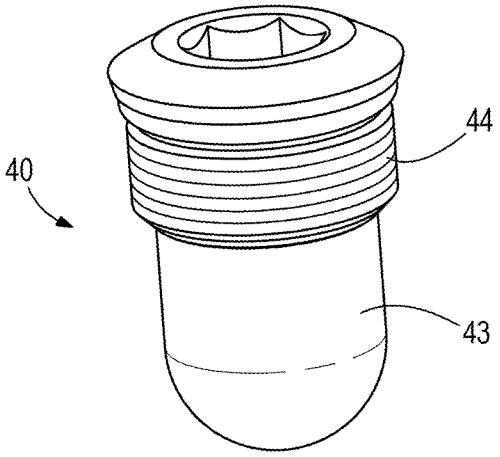
FIG. 10 shows an example of a plug for isolating cooling fluid in first and second flow paths in the cast part from an opposite side of the cast part.

Referring to FIGS. 9 and 10, an exemplary plug 40 can include a body 43 that is made of metal and threads 44 that engage with the threads 41 in the passageway. The threaded engagement promotes a good seal between the plug 40 and the cast part so that the cooling jacket remains completely sealed from the opposite side (e.g. oil deck) of the cylinder head 10. FIG. 9 shows the cylinder head 10 after the plug 40 has been inserted into the passageway 31. The body 43 extends into the passageway 31 to at least partially separate the first and second flow paths 24, 28 from each other, thus promoting the above-described split-flow of cooling fluid.

Figure 11:
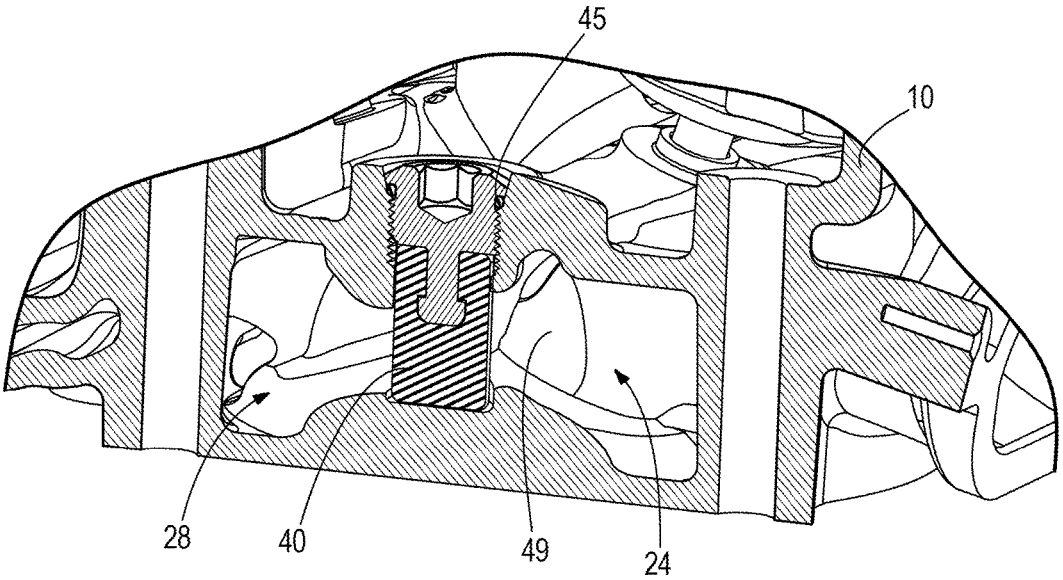
FIG. 11 shows an alternate example of a plug for isolating the cooling fluid in the first and second flow paths from the opposite side of the cast part.
Figure 12:
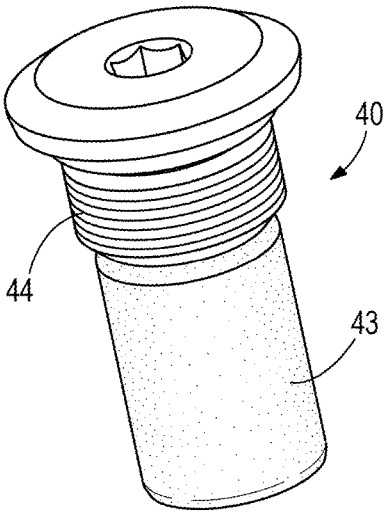
FIG. 12 is a perspective view of the plug shown in FIG. 11.

FIGS. 11 and 12 are views like FIGS. 9 and 10 and show another example of the plug 40. In this example, the body 43 is made of rubber. The threads 44 form a seal with the passageway 31 via threads 41. An O-ring 45 is disposed between the plug 40 and passageway 31 to seal the passageway 31 and further prevent cooling fluid from leaking to the opposite side of the cylinder head 10.

The present inventor has further realized that in certain embodiments it can be desirable to intentionally permit some flow of cooling fluid from the first flow path 24 to the second flow path 28 via the passageway 31. That is, in some embodiments, it can be advantageous to permit a certain amount of cooling fluid to bypass (i.e., short circuit) downstream portions of the first flow path 24 and upstream portions of the second flow path 28 via the passageway 31. The inventor further realized that it is possible to purposefully machine the passageway 31 so that it does not form a complete seal with the body 43 (or alternately to select the configuration of the plug 40 so that it does not form a complete seal with the passageway 31), thus permitting a partial flow (i.e. a short circuit flow) of cooling fluid there through. The difference in size and/or shape of the passageway 31 and body 43 can be purposefully selected to as to attain a desired amount of "short circuit" fluid flow. Thus it is possible to tune of the cooling flow system by metering the short circuit cooling flow between the first and second flow paths 24, 28, using plugs that are sized (length and/or diameter) to match specific flow requirements. In examples where there are multiple passageways 31 and plugs 40, all or only some of the passageways 31 can be machined in this way so as to achieve desired leakage of cooling fluid at desired locations along the length of the first and second cooling paths 24, 28.

It will thus be seen that the present disclosure provides improved assemblies for forming a cast part of a marine engine and particularly for forming a cylinder head of the marine engine, such as for example the cylinder head 10 shown in FIG. 1. The assembly can include the mold 15 for forming the cast part of the marine engine, a longitudinally elongated and monolithic cooling jacket core 20 disposed in the mold 15, the cooling jacket core 20 having a longitudinally elongated first portion 22 that forms a first flow path 24 for conveying cooling fluid through the cast part in a first direction and a longitudinally elongated second portion 26 that forms an opposite, second flow path 28 for conveying cooling fluid through the cast part in an opposite, second direction, wherein the first and second portions 22, 26 are laterally spaced apart from each other. The cooling jacket core 20 can further include at least one bridge 30 that integrally supports the first and second portions 22, 26 with respect to each other during the casting process. The assembly can further include at least one plug 40 that is configured to fit in the cast part where the bridge 30 was located so as to at least partially separate the first and second flow paths 24, 28 from each other and to separate the first and second flow paths 24, 28 from the opposite side of the cast part. As described herein above, the cooling jacket core 20 can optionally include at least one supporting printout 32 located adjacent the bridge 30 and configured to support the cooling jacket core 20 with respect to the mold 15.

As described herein above, the cast part can be a cylinder head 10 of the marine engine, wherein the first flow path 24 is configured to convey cooling fluid alongside intake valves in the cylinder head 10, and wherein the second flow path 28 is configured to convey cooling fluid alongside exhaust valves in the cylinder head 10. In some examples, the cooling jacket core 20 can further comprise an elongated third portion 34 that forms a third flow path 36 for cooling fluid to flow alongside an exhaust conduit cast with the cylinder head 10 by the mold 15.

As described herein above, the present disclosure further provides methods of forming a cooling jacket in a cast part of a marine engine. The method can comprise (1) positioning a longitudinally elongated and monolithic cooling jacket core into a mold for forming the cast part of the marine engine, the cooling jacket core having a longitudinally elongated first portion that forms a first flow path for conveying cooling fluid through the cast part in a first direction, and a longitudinally elongated second portion that forms an opposite, second flow path for conveying cooling fluid through the cast part in an opposite, second direction, wherein the first and second portions are laterally spaced apart from each other, and wherein the cooling jacket core further comprises at least one bridge that integrally supports the first and second portions with respect to each other during casting; (2) casting a metal in the mold to form a cast part and thereafter breaking down and removing the cooling jacket core from the cast part to thereby open the first and second flow paths; and (3) or inserting at least one plug into the cast part where the at least one bridge was located so as to at least partially isolate the first and second flow paths from each other. The methods can further optionally comprise: (4) machining the at least one supporting printout to form a passageway, wherein the at least one plug is inserted into the passageway. The methods can further optionally comprise (5) machining the cast part so that when the plug is inserted where the at least one bridge was located, a gap occurs between the plug and the cast part, the gap being configured to allow a portion of the cooling fluid to pass by the plug from the first flow path to the second flow path. The methods can further optionally comprise (6) machining the cast part so that the gap has a size that is selected to achieve a desired amount of leakage of cooling fluid past.

Thus apparatuses, assemblies and methods of the present disclosure advantageously enable formation of a split-flow cylinder head cooling jacket using plugs to prevent short circuit of cooling fluid, and preventing the cooling fluid from entering the engine and mixing with oil therein. The one piece cooling jacket core facilitates improved casting manufacturability over the prior art, as described herein above.

Through research and experimentation, the present inventors have determined that the bridge in the sand core that connects the multiple flow paths forms a passage, which if not sealed (or partially sealed), will have a large short circuit of fluid flow from one flow path to the other. This passage formed by the bridge must be sealed or partially sealed (with controlled leak rate) with the fluid dam (i.e. plug). The bridge does not need to have a connected printout connecting the cooling jacket to the oil cavity (or outside of the part), but in certain examples can be added since it helps locate and support the cooling jacket cores. Without the printout, the way a dam (i.e. plug) could be inserted would be by machining an access hole. With a cast printout hole, it is possible that a dam could be inserted, seal (or partially seal) the cast surfaces between the flow paths and seal the cooling jacket (both flow paths) from the oil cavity (or outside of the part).

Machining the access hole, or further opening the access hole formed by the printout, provides precision smooth surfaces for better sealing with the fluid dam (or a more precisely controlled leak). It also conveniently provides a method to secure the fluid dam (with the threaded portion of the plug) and provides a seal to the oil cavity (or outside of the part). The sealing to the oil cavity (or outside of the part) could be made with methods other than the depicted O-ring style plug (shown in FIG. 11).

This written description uses examples to disclose embodiments of the invention, including the best mode, and also to enable any person skilled in the art to make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for forming a cooling jacket in a cast part of a marine engine, wherein the cast part extends from top to bottom along a longitudinal axis and from side to opposite side along a lateral axis that is perpendicular to the longitudinal axis, the method comprising:

positioning a longitudinally elongated and monolithic cooling jacket core into a mold for forming the cast part, the cooling jacket core having a longitudinally elongated first portion that forms a first flow path for conveying cooling fluid through the cast part in a first direction, and a longitudinally elongated second portion that forms an opposite, second flow path for conveying cooling fluid through the cast part in an opposite, second direction, wherein the first and second portions are laterally spaced apart from each other, and wherein the cooling jacket core further comprises at least one bridge that integrally supports the first and second portions with respect to each other during casting;

casting metal in the mold to form the cast part and thereafter breaking down and removing the cooling jacket core from the cast part to thereby open the first and second flow paths; and inserting at least one plug into the cast part where the at least one bridge was located so as to at least partially isolate the first and second flow paths from each other, while sealing the first and second flow paths from an opposite side of the cast part.

2. The method according to claim 1, wherein the cooling jacket core comprises at least one supporting printout located adjacent the at least one bridge and being configured to support the cooling jacket core with respect to the mold, the method further comprising: machining the at least one supporting printout to further open a passageway left by the at least one bridge between the first and second flow paths, wherein the at least one plug is inserted into the passageway.

3. The method according to claim 2, wherein the at least one supporting printout is one of a plurality of supporting printouts that are longitudinally spaced apart along the cooling jacket core, wherein the at least one bridge is one of a plurality of bridges that are longitudinally spaced apart along the cooling jacket core.

4. The method according to claim 1, wherein the cast part comprises a cylinder head for the marine engine, wherein the first flow path is configured to convey the cooling fluid alongside intake valves in the cylinder head, and wherein the second flow path is configured to convey the cooling fluid alongside exhaust valves in the cylinder head.

5. The method according to claim 1, wherein the mold is configured to form an exhaust conduit for transferring exhaust gases from the marine engine, wherein the cooling jacket core further comprises an elongated third portion that forms a third flow path for conveying cooling fluid alongside the exhaust conduit.

6. The method according to claim 1, further comprising machining the cast part so that the plug seals with the cast part and prevents the cooling fluid from leaking past the plug to the opposite side of the cast part.

7. The method according to claim 1, further comprising machining the cast part so that a desired amount of leakage of cooling fluid is permitted past the plug from the first flow path to the second flow path.

8. The method according to claim 1, wherein the plug is formed at least partially of metal.

9. The method according to claim 1, wherein the plug is formed at least partially of rubber.

10. The method according to claim 1, further comprising an O-ring that forms a seal between the plug and the cast part and prevents flow of cooling fluid from the first and second flow paths to the opposite side of the cast part.

* * * * *